United States Patent [19]

Okada et al.

[11] Patent Number: 4,773,647

[45] Date of Patent: Sep. 27, 1988

[54] SLOT MACHINE WITH STOP SWITCH ENABLEMENT AFTER ATTAINMENT OF MINIMUM REEL SPEED

[75] Inventors: Kazuo Okada; Toshio Yamamoto, both of Tokyo, Japan

[73] Assignee: Kabushiki Kaisha Universal, Tochigi, Japan

[21] Appl. No.: 636,799

[22] Filed: Aug. 2, 1984

Related U.S. Application Data

[63] Continuation of Ser. No. 414,402, Sep. 2, 1982, abandoned.

[30] Foreign Application Priority Data

Sep. 7, 1981 [JP] Japan ..... 56-139679

[51] Int. Cl.[4] ..... A63F 5/04

[52] U.S. Cl. ..... 273/143 R

[58] Field of Search ..... 273/143 B, 142 R, 142 B, 273/142 H, 142 HA; 446/47, 242; 377/24

[56] References Cited

U.S. PATENT DOCUMENTS

| | | | |
|---|---|---|---|
| 1,483,873 | 2/1924 | Dey | 250/465.1 |
| 3,759,525 | 9/1973 | Davis | 273/143 R |
| 3,770,269 | 11/1973 | Elder | 273/1 GC |
| 3,977,357 | 8/1976 | O'Neal et al. | 250/465.1 |
| 4,095,795 | 6/1978 | Saxton et al. | 273/138 A |
| 4,099,722 | 7/1978 | Rodesch et al. | 273/143 R |
| 4,217,484 | 8/1980 | Gerst | 377/24 |
| 4,353,554 | 10/1982 | Fisher | 273/138 A |

FOREIGN PATENT DOCUMENTS

| | | | |
|---|---|---|---|
| 1292712 | 10/1972 | United Kingdom | 273/143 R |
| 1528507 | 12/1978 | United Kingdom | 273/143 R |

*Primary Examiner*—Maryann Lastova
*Attorney, Agent, or Firm*—Young & Thompson

[57] ABSTRACT

A slot machine of the type having a plurality of reels and pulse motors for rotating the respective reels wherein the pulse motors can be stopped individually by touching stop switches provided one for each of the respective reels. Every stop switch is provided with a light-emitting indicator for indicating that the stop switch is operable, and the stop switch becomes operable only when its corresponding pulse motor, and hence the associated reel, has reached a predetermined speed of rotation. In this way, the display of selected symbols cannot be controlled by the player stopping the reels during an initial phase of their movement when they are turning only very slowly.

3 Claims, 3 Drawing Sheets

SLOT MACHINE WITH STOP SWITCH ENABLEMENT AFTER ATTAINMENT OF MINIMUM REEL SPEED

This application is a continuation of application Ser. No. 414,402 filed Sept. 2, 1982, now abandoned.

BACKGROUND OF THE INVENTION

The present invention relates to slot machines of the type having a plurality of reels caused to rotate by pulse motors and, in particular, to slot machines of the type in which a plurality of reels are brought to a stop by pushing stopswitches respectively associated therewith.

In conventional slot machines, a plurality of reels rotatably arranged side by side are caused to rotate and to stop by a kick lever and stop levers associated therewith, respectively. At the outset, a handle is pulled to disengage the stop levers from one of the notches or projections in a row on a dividing disc fixed to the side surface of the respective reel, and then to engage the kick lever with one of the notches or projections. At the end of the pulling of the handle, the kick lever is released so as to disengage from the dividing disc under the force of a spring. At this time, owing to a rapid movement of the kick lever in a tangential direction of the dividing disc, rotation of the dividing disc, and hence the reel, is caused. Upon pushing stop buttons associated with the respective reels, the stop levers which had been kept out of the notches or projections of the respective dividing discs are again brought into engagement with those notches or projections under force of biassing springs, thereby to stop the respective reels. A slot machine of the type having three reels is provided with three stop buttons associated one with each of the reels, so as to stop the reels, individually, upon pushing the stop buttons. Such a slot machine of the type with a mechanical drive is not only very complicated in its structure, but also lacks sufficient rigidity in its structural elements such as the dividing discs, kick levers, stop levers and the like.

A slot machine of the type having pulse motors associated with the respective reels, which attempts to eliminate the above-mentioned disadvantages, is described in, for instance, U.S. Pat. No. 4,099,722. The slot machine described therein is so constructed that, upon pulling a handle to cause switches to turn on, pulse motors associated with the respective reels start to rotate, causing the respective reels to rotate individually. After the proper lapses of time predetermined by random timer means, the respective reels are automatically individually stopped. The slot machines of the type having pulse motor drive are so designed that the drive pulses for the reels, the recognition of the various combinations of different symbols, and the paying out of coins as prizes, are electrically performed. This conduces to slot machines of small size and good durability. However, there is the disadvantage in this type of slot machine, that it is not possible to stop at random the respective reels.

OBJECTS OF THE INVENTION

It is therefore an object of the present invention to provide a slot machine of the type having pulse motors associated with reels, in which the reels are individually stopped by arbitrary operations.

It is another object of the present invention to provide a slot machine of the type having pulse motors associated with reels, in which stop switches associated with the respective pulse motors having light-emitting means therein for giving indications during which the stop switches can be actuated.

It is still another object of the present invention to provide a slot machine of the type having pulse motors associated with the reels, in which stop switches are actuated to stop the pulse motors, hence the reels, merely by the touch of a finger.

SUMMARY OF THE INVENTION

The above objects of the present invention are achieved by providing stop switches associated with respective reels so as to stop the pulse motors, and hence the reels, individually, upon pushing the stop switches. The stop switches which are actuated by touching with a finger are disposed on the slot machine housing.

In general, in a slot machine of the type having motor drive, pulse motors gradually gain in speed and finally reach a steady speed after a fixed period of time. Therefore, since the reels are at first turning only slowly, the symbols on the outer peripheral surfaces of the reels are visible to the players during the rotation thereof. This allows the players, if they are skilled in the operation of the machine, to push stop switches in accordance with their observation of the symbols during the early period of rotation of the reels so as to cause predetermined prize-winning combinations of symbols to appear when all the reels have stopped. It is therefore desirable to design a slot machine so that the pulse motors do not stop before reaching a steady speed, even though the stop switches are pushed. However, this results in a discrepancy between the times at which the stop switches are actuated and the times that the reels are brought to a stop. Therefore, in the preferred embodiment of the present invention, the stop switches are provided with light-emitting means therein for indicating whether the stop switches are operable or not.

DETAILED DESCRIPTION OF THE INVENTION

Figure 1:
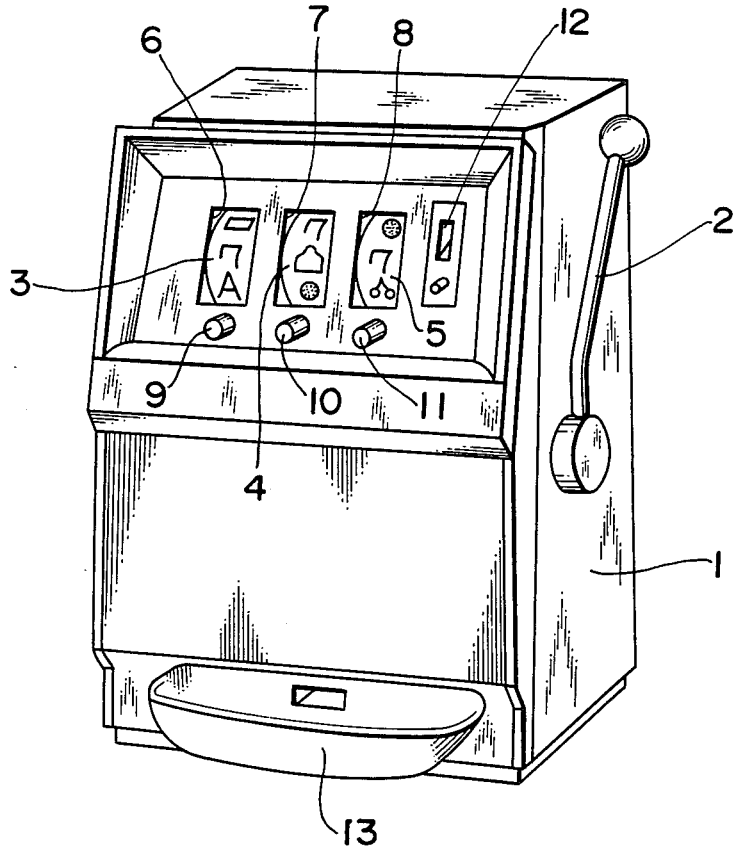
FIG. 1 is a perspective view showing a slot machine according to the invention.

Referring now to FIG. 1, there is shown a slot machine 1 wherein reels 3 to 5 are simultaneously caused to individually rotate by the pulling of a handle 2. On the outer peripheral surface of the reels 3 to 5 is printed or otherwise provided an annular series of spaced symbols such as a lemon, a cherry, a figure seven or the like; and a combination of three symbols, one for each reel, is visible through windows 6 to 8.

The reels 3 to 5 can be brought to a stop upon touching respective stop switches 9 to 11 associated therewith. With the introduction of coins or tokens through a coin or token receiver 12, the slot machine will automatically release the handle 2 which is locked by means of a conventional magnet (not shown), allowing players to play games. When any of the predetermined prize-winning combinations of symbols occurs, the slot machine pays out coins or tokens as prizes into a coin saucer 13. Prize coins are paid out in proportion to the number of coins which have been put into the coin receiver 12. For example, if the number of coins having been put in is one, two or three, the number of coins paid out is two, four or six, respectively. Generally, there are illuminated indicia (not shown) to show the number of coins inserted.

Figure 2:
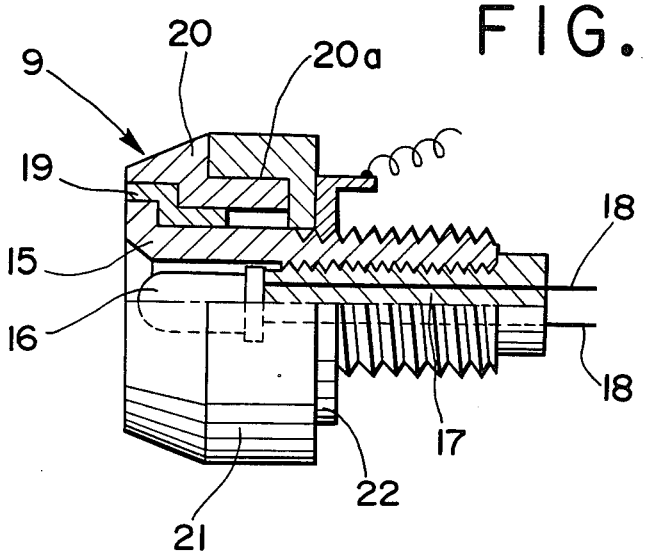
FIG. 2 is a side view, partly in section, of a stop switch.

FIG. 2 shows a stop switch provided with a light-emitting diode (LED) 16 in an inner cylinder 15. The LED 16 is positioned on a holder 17 of insulating material and is fed by wires 18 through passages in the holder 17. The holder with the LED attached is screwed into the inner cylinder 15.

A spacer ring 19 of insulating material is fitted around an end of cylinder 15 and an outer cylinder 20 is fitted around 19. The outer cylinder 20 about its shoulder 20*a* is covered with a ring 21 of insulating material which is retained by a lock ring 22.

Figure 3:
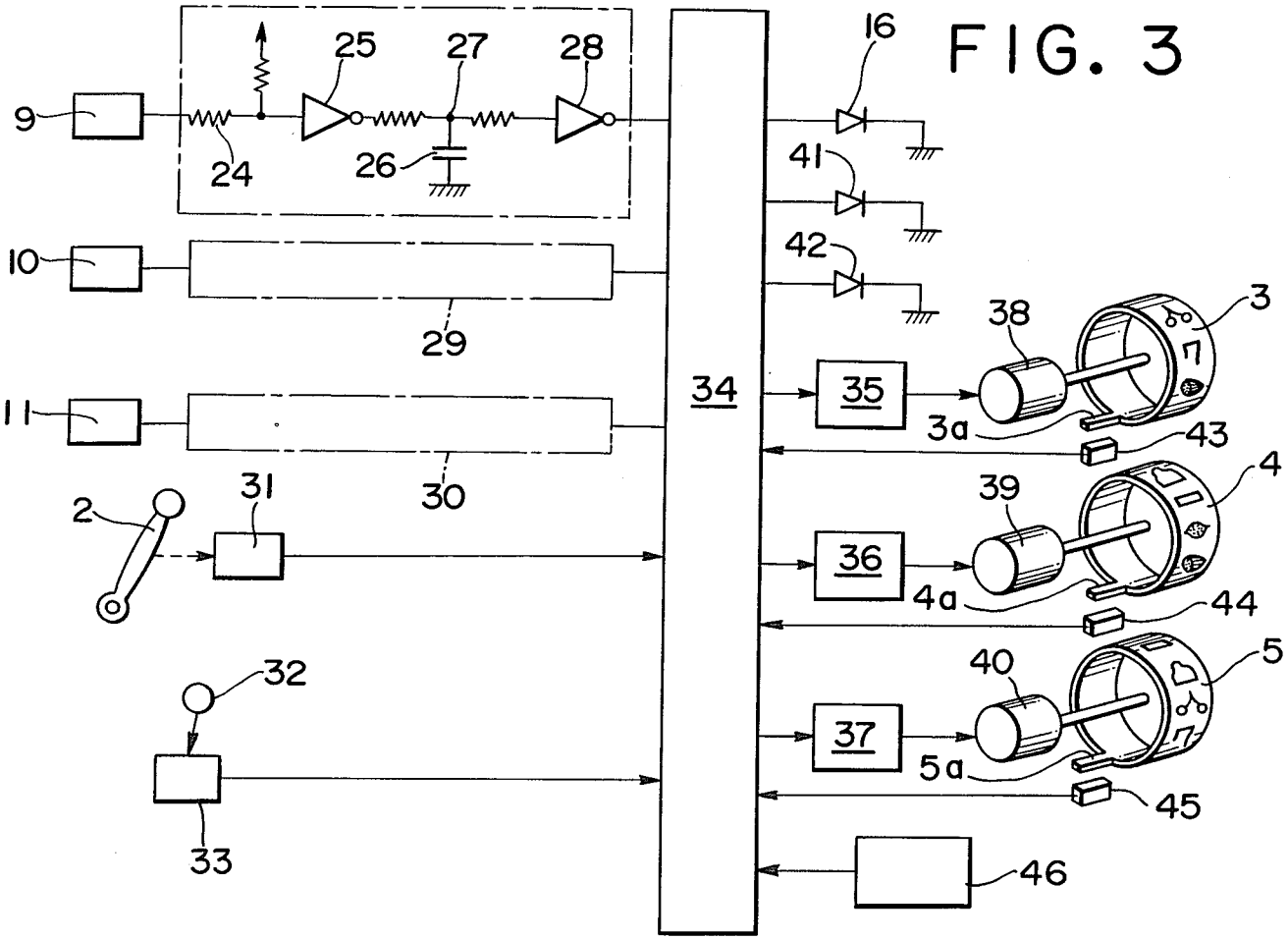
FIG. 3 is a block diagram showing the electrical circuit.

Referring to FIG. 3 showing the electrical diagram, the stop switch 9 is connected to an inverter 25 to which a high voltage is applied through a resistor 24. The inverter 25 at its output terminal is changed from "L" (low) to "H" (high) in output upon touching the stop switch 9 with the finger. At this time, a capacitor 26 is caused to start to charge until the voltage arising at a connection 27 reaches a predetermined voltage level. This predetermined voltage at the connection 27 causes an inverter 28 at its output terminal to change from "H" to "L". Consequently, an instantaneous touching of the stop switch 9 does not cause it to be actuated because of insufficient charge of the capacitor 26.

In the same way, the stop switches 10 and 11 coact with respective checking circuits 29 and 30 associated therewith. There are further provided switches 31 and 33 which are so constructed as to turn on upon pulling the handle 2 and upon inserting a coin 32 into the coin receiver 12, respectively.

Figure 4:
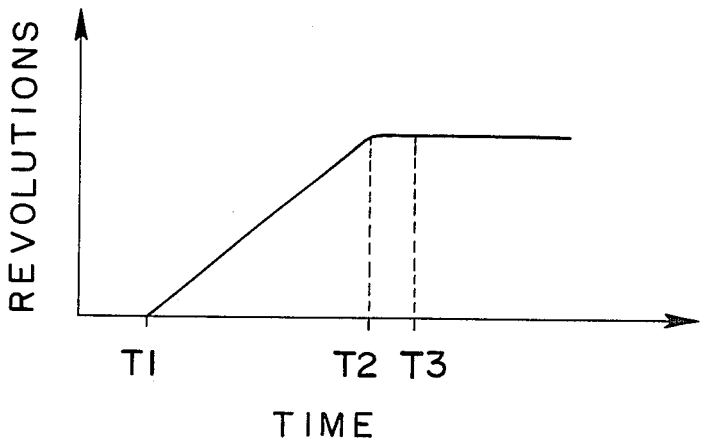
FIG. 4 is a graph showing the speed of rotation of a pulse motor with time.

A conventional micro-computer 34 causes the handle 2 to be operable when the switch 33 is turned on, and then allows a game program to begin so as to control motor control circuits 35 to 37 when the switch 31 is turned on by the handle 2 being pulled. The motor control circuits 35 to 37 generate pulses with periods which become gradually shorter thereby to drive pulse motors 38 to 40. As shown in FIG. 4, the pulse motors 38 to 40 start to rotate at a time Tl and attain a constant speed at a time T2 after gradually increasing in speed. It is to be noted that the pulse motors 38 to 40 sometimes stop without synchronism. In this case it is important to increase gradually their speeds after resetting the motor control circuits 35 to 37. This operation is previously programmed into the microcomputer 34 and thus automatically takes place upon the detection of desynchronization of the pulse motors 38 to 40.

At a time T3, after a constant speed has been attained, the LED's 16, 41 and 42 provided on the stop switches 9, 10 and 11, respectively, are caused to emit light.

When the stop switches 9 to 11 are pushed at random after the LED's 16, 41 and 42 are caused to emit light, the pulse motors 38 to 40 are caused to stop in dependence on the disappearance of pulses thereto, and hence the reels 3 to 5 stop. The reels 3 to 5 are provided with light-shielding members 3*a*, 4*a* and 5*a*, respectively, which are detected by light-sensing means 43 to 45 upon passing thereover. Signals from the light-sensing means 43 to 45 are fed to the micro-computer 34 to reset the previous contents of a counter which is so designed as to determine the combinations of symbols displayed in the windows 6 to 8 based on a correlation between the number of pulses and combinations of symbols previously determined by counting the number of pulses fed to the pulse motors 38 to 40. The microcomputer 34 determines the occurrence of a predetermined combination of symbols in the transverse row or in a diagonal row, and decides the number of coins to be paid out as a prize corresponding to the occurrence of prize-winning combinations. This can be performed by using a ROM which is accessed by signals coded corresponding to combinations of symbols. The micro-computer 34 controls a coin pay-out device 46 to pay out a predetermined number of coins into the saucer 13. These latter operations are of course effected in an entirely conventional manner, which accordingly need not be described in greater detail.

What is claimed is:

1. A slot machine of the type having a plurality of reels driven by pulse motors associated therewith, comprising a plurality of stop switches provided one for each of the respective reels for generating stop signals, each said stop switch comprising a sensor switch which is turned on by touching with a finger, each said stop switch having a light emitting means therein, said light emitting means being illuminated only when said stop switch is operable, and means rendering said stop switches operable only after said reels have attained a predetermined speed of rotation and are rotating at said predetermined speed of rotation.

2. A slot machine as defined in claim 1, wherein said stop switch has a cylindrical wall with a hole therein and a holder of insulating material with said light-emitting means attached to one end thereof disposed in said hole.

3. A slot machine as defined in claim 2, wherein said light-emitting means is a light emitting diode (LED).

* * * * *